US011391271B2

(12) United States Patent
Lim et al.

(10) Patent No.: US 11,391,271 B2
(45) Date of Patent: Jul. 19, 2022

(54) COMPRESSOR

(71) Applicant: LG Electronics Inc., Seoul (KR)

(72) Inventors: Hyeongjun Lim, Seoul (KR); Jungsik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/086,945

(22) Filed: Nov. 2, 2020

(65) Prior Publication Data

US 2021/0180580 A1 Jun. 17, 2021

(30) Foreign Application Priority Data

Dec. 12, 2019 (KR) ..... 10-2019-0165442

(51) Int. Cl.
*F04B 39/00* (2006.01)
*F04B 39/12* (2006.01)

(52) U.S. Cl.
CPC ..... *F04B 39/0027* (2013.01); *F04B 39/0005* (2013.01); *F04B 39/121* (2013.01);
(Continued)

(58) Field of Classification Search
CPC ..... F04B 39/0027; F04B 39/0005; F04B 39/121; F04B 39/0072; F04B 39/0088; F04B 39/0044; F04B 39/0055; F04B 39/0061; F04B 39/0038; F04B 39/0016; F04B 35/045; F04B 39/123
See application file for complete search history.

(56) References Cited

U.S. PATENT DOCUMENTS

2015/0004014 A1* 1/2015 Kim ..... F04B 39/0027 417/312
2018/0223822 A1* 8/2018 Lee ..... F04B 53/128
(Continued)

FOREIGN PATENT DOCUMENTS

EP 3511571 7/2019
KR 1020190031048 3/2019
(Continued)

OTHER PUBLICATIONS vocabulary.com; see attached arc—Dictionary Definition _ Vocabulary.com pdf from vocabulary.com/dictionary/arc (Year: 2021).*
(Continued)

*Primary Examiner* — Kenneth J Hansen
*Assistant Examiner* — David N Brandt
(74) *Attorney, Agent, or Firm* — Fish & Richardson P.C.

(57) ABSTRACT

A compressor is disclosed, which comprises a case, a cylinder disposed inside the case, a piston moving inside the cylinder, and a muffler provided in the piston. The muffler includes a fluid pipe provided with a resonant space formed between an outer circumferential surface and an inner circumferential surface of the piston, and a guide panel protruded from the outer circumferential surface of the fluid pipe to the inner circumferential surface of the piston and extended along an outer circumferential direction of the fluid pipe. The guide panel is provided in a plural number, and is partially opened along the outer circumferential direction of the fluid pipe to form an open area, and the open area formed in any one guide panel is covered by its adjacent guide panel.

18 Claims, 6 Drawing Sheets

(52) U.S. Cl.
CPC ..... *F04B 39/0038* (2013.01); *F04B 39/0044* (2013.01); *F04B 39/0061* (2013.01); *F04B 39/0072* (2013.01); *F04B 39/0088* (2013.01)

(56) References Cited

U.S. PATENT DOCUMENTS

| | | | | |
|---|---|---|---|---|
| 2019/0219312 | A1* | 7/2019 | Lee | F04B 39/0044 |
| 2019/0345924 | A1* | 11/2019 | Hahn | F04B 39/1073 |

FOREIGN PATENT DOCUMENTS

| | | |
|---|---|---|
| KR | 101990138 | 6/2019 |
| KR | 101990146 | 6/2019 |

OTHER PUBLICATIONS

KR Notice of Allowance in Korean Appln. No. 10-2019-0165442, dated Dec. 16, 2020, 7 pages (with English translation).
Office Action in German Appln. No. 102020213400.6 dated Oct. 6, 2021, 8 pages (with English translation).

* cited by examiner

COMPRESSOR

CROSS REFERENCE TO RELATED APPLICATION

This application claims the benefit of Korean Patent Application No. 10-2019-0165442, filed on Dec. 12, 2019, which is hereby incorporated by reference as if fully set forth herein.

TECHNICAL FIELD

The present disclosure relates to a compressor, and more particularly, to a compressor configured to compress a fluid through a linear reciprocating movement of a piston.

BACKGROUND

A compressor is an apparatus receiving a power from a power generator such as a motor and a turbine to compress the air or a fluid. The compressor is widely applied to the whole industry or home appliances.

The compressor may be configured such that a cylinder is arranged inside a case, which forms a sealing space, to form a compression chamber and a piston reciprocates inside the cylinder.

In this case, as the piston moves to be arranged at a bottom dead center (BDC), a fluid in the sealing space is sucked to the compression chamber. Then, as the piston moves to be arranged at a top dead center (TDC), the fluid in the compression chamber is compressed and then discharged. This process is repeated.

Meanwhile, a compressor comprising a cylinder and a piston is disclosed in the Korean Laid-Open Patent No. KR 10-2019-0031048 A1. In detail, a muffler is coupled to the piston of the compressor, and the fluid is supplied to the inside of the piston through the muffler.

However, vibration or noise may occur in the compressor in the process of operating the compressor. In order to attenuate the vibration and the noise, a resonator may be provided in the compressor or a space where resonance is induced may be arranged. The compressor disclosed in the KR 10-2019-0031048 A1 may be unfavorable in properly attenuating vibration or noise in a limited space inside the case or the piston.

Therefore, it is important to develop a compressor, which may effectively attenuate vibration or noise, which may occur in the process of operating the compressor, by using a limited space in this art.

SUMMARY

Accordingly, the present disclosure is directed to a compressor that substantially obviates one or more problems due to limitations and disadvantages of the related art.

An object of the present disclosure is to provide a compressor that may effectively attenuate vibration and noise, which may occur in the process of compressing a fluid.

Another object of the present disclosure is to provide a compressor that may effectively control a target frequency of vibration and noise to be attenuated by controlling a noise transfer path.

Additional advantages, objects, and features of the present disclosure will be set forth in part in the description which follows and in part will become apparent to those having ordinary skill in the art upon examination of the following or may be learned from practice of the present disclosure.

The objectives and other advantages of the present disclosure may be realized and attained by the structure particularly pointed out in the written description and claims hereof as well as the appended drawings.

To achieve these objects and other advantages and in accordance with the purpose of the present disclosure, as embodied and broadly described herein, particular implementations of the present disclosure provide a compressor that include a case, a cylinder, a piston, and a muffler. The case can include a suction pipe configured to suction a fluid. The cylinder can be disposed inside the case. The piston can be configured to reciprocate in the cylinder and define a compression chamber between the cylinder and a first piston end of the piston. The piston can define a fluid space that is configured to receive the fluid from the case. The first piston end can define a fluid hole that is configured to transfer the fluid from the fluid space to the compression chamber. The muffler can be disposed at a second piston end of the piston that is opposite to the first piston end. The muffler can include (i) an inlet hole configured to receive the fluid from the case and (ii) a discharge hole configured to discharge the fluid to the fluid space of the piston. The muffler can include a fluid pipe and a plurality of guide panels. The fluid pipe can be at least partially disposed in the fluid space and have an end that defines the discharge hole. The fluid pipe can define a resonant space between an outer circumferential surface of the fluid pipe and an inner circumferential surface of the piston. The plurality of guide panels can protrude from the outer circumferential surface of the fluid pipe toward the inner circumferential surface of the piston and extend along an outer circumferential direction of the fluid pipe. The plurality of guide panels can be spaced apart from each other along a longitudinal direction of the fluid pipe. Each of the plurality of guide panels can define an open area around the outer circumferential surface of the fluid pipe in the resonant space. The open area can overlap with an adjacent guide panel of the plurality of guide panels along the longitudinal direction of the fluid pipe.

In some implementations, the compressor can optionally include one or more of the following features. The compressor can include a valve member that is disposed at the first piston end and configured to open or close the fluid hole of the piston. The valve member can be configured to elastically deform to open the fluid hole based on a pressure within the fluid space being higher than a pressure of the compression chamber. The compressor can include a piston driver that is disposed between the cylinder and the case and that includes a winding coil configured to generate an electromagnetic force to linearly move the piston. Each of the plurality of guide panels can extend along the outer circumferential direction of the fluid pipe in an arc shape and surrounds a first circumferential part of the outer circumferential surface of the fluid pipe along the outer circumferential direction of the fluid pipe. The open area of each of the plurality of guide panels can be disposed at a second circumferential part of the outer circumferential surface of the fluid pipe along the outer circumferential direction of the fluid pipe. Each of the plurality of guide panels can include a half-arc shape that surrounds a half of the outer circumferential surface of the fluid pipe along the outer circumferential direction of the fluid pipe. The open area of each of the plurality of guide panels can be disposed to be opposite to the open area of the adjacent guide panel of the plurality of the guide panels. Each of the plurality of guide panels can have a curved end that contacts an inner side of the piston. Each of the plurality of guide panels can include a radial end that is configured to flex away from the compression chamber based on the radial end contacting the inner side of the piston. The fluid pipe can have a diameter that increases toward the discharge hole along the longitudinal direction. A first guide panel of the plurality of guide panels can have a radial height that is greater than a radial height of a second guide panel of the plurality of guide panels. The second guide panel is positioned closer to the discharge hole than the first guide panel. The fluid pipe can extend between the first piston end and the second piston end. The fluid that enter through the suction pipe can be received in the case. The inlet hole of the muffler can be disposed at an opposite side of the compression chamber such that the fluid that is received in the case enters the inlet hole based on movement of the piston. The muffler can define a plurality of buffering spaces between the inlet hole and the fluid pipe. The plurality of buffering spaces can be aligned along a longitudinal direction of the piston. The fluid that enters through the inlet hole can pass through the plurality of buffering spaces. The suction pipe, the inlet hole and the fluid pipe can be arranged on a straight line along the longitudinal direction of the piston. The plurality of buffering spaces can be divided by partitions. The fluid can be transferred to the plurality of buffering spaces through communication holes that are defined in the partitions respectively. The first circumferential part and the second circumferential part of the outer circumferential surface of the fluid pipe can define a full circumference of the outer circumferential surface of the fluid pipe along the outer circumferential direction of the fluid pipe. Each of the plurality of guide panels can have a radial height that is greater than a radial height of an adjacent guide panel of the plurality of guide panels. The adjacent guide panel is positioned closer to the discharge hole than the each of the plurality of guide panels. The muffler can include a coupler that connects the muffler to the piston. The muffler can include outer and inner body portions. The coupler can be coupled to the inner body portion of the muffler.

To achieve these objects and other advantages and in accordance with the purpose of the present disclosure, as embodied and broadly described herein, a muffler of a compressor according to one embodiment of the present disclosure may attenuate noise by allowing a fluid to pass through a complicated path structure in the middle of transferring the fluid to a compression chamber.

The muffler may include a fluid pipe inserted into a piston, and outer and inner body portions connected to the fluid pipe. The muffler may attenuate noise by using resonance of a space formed near a path, that is, a cavity.

The muffler of the compressor may use a resonant characteristic of a side branch resonator formed between the fluid pipe and the piston, and may be unfavorable for attenuation of low frequency noise if the fluid pipe is not enough long.

One embodiment of the present disclosure may suggest a muffler structure that may attenuate low frequency noise even in a narrow space. For example, a protrusion outside the fluid pipe may be designed asymmetrically to constitute a zigzag shaped path between the fluid pipe and the piston.

Therefore, if the path of the side branch resonator near the fluid pipe has a zigzag shape, an acoustic effective length may be increased, whereby a target frequency of the side branch resonator may be more lowered.

In one embodiment of the present disclosure, since partitions partially opened outside the fluid pipe, that is, guide panels are protruded, cavity spaces between the piston and the fluid pipe are connected in a zigzag shape, whereby an effective length of the side branch resonator may be increased.

A resonant frequency of the side branch resonator may be calculated as expressed by $F=C/4L$, wherein L is increased to effectively attenuate low frequency noise.

The partitions outside the fluid pipe should serve to increase an effective length of the cavity and are in contact with an inner wall of the cylinder to detach front and rear spaces of the partitions from each other. At this time, the partitions may be designed to have a tapered end shape to be elastically inserted, whereby a dimensional tolerance may be disregarded.

A compressor according to one embodiment of the present disclosure comprises a case having a suction pipe to which a fluid is sucked, a cylinder arranged inside the case, a piston moving inside the cylinder, provided with a compression chamber formed between one end and the cylinder, a fluid space into which the fluid in the case flows, and a fluid hole formed at the one end to transfer the fluid of the fluid space to the compression chamber, and a muffler provided at the other end of the piston, including an inlet hole for allowing the fluid in the case to enter there and a discharge hole for discharging the fluid to the fluid space.

Also, the muffler includes a fluid pipe partially arranged inside the fluid space, having an end where the discharge hole is arranged, and provided with a resonant space formed between an outer circumferential surface and an inner circumferential surface of the piston, and a guide panel protruded from the outer circumferential surface of the fluid pipe to the inner circumferential surface of the piston and extended along an outer circumferential direction of the fluid pipe.

Meanwhile, the guide panel is provided in a plural number, and may be arranged to be spaced apart from another guide panel in the resonant space along a length direction of the fluid pipe, and is partially opened to form an open area, and the open area may be formed in any one guide panel based on the length direction of the fluid pipe and covered by its adjacent guide panel.

The compressor may further comprise a valve member arranged at the one end of the piston, opening or closing the fluid hole. The valve member may be elastically deformed to open the fluid hole if a pressure of the fluid space is higher than that of the compression chamber at a reference pressure or more.

The compressor may further comprise a driving unit arranged between an outer side of the cylinder and an inner side of the case, including a winding coil and linearly moving the piston by means of an electromagnetic force of the winding coil.

The guide panel may be extended along an outer circumferential direction of the fluid pipe in an arc shape to partially surround the outer circumferential surface of the fluid pipe when viewed in a length direction of the fluid pipe, and the open area may be formed on the other of the outer circumferential surface of the fluid pipe.

The guide panel may be provided in a self-arc shape to surround a half of the outer circumferential surface of the fluid pipe when viewed in the length direction of the fluid pipe.

An open area of any one of the plurality of guide panels may be arranged to be opposite to an open area of another guide panel adjacent thereto based on the fluid pipe.

The guide panel may have a curved end which is in contact with an inner side of the piston. The guide panel may be provided in a curved shape to be far away from the compression chamber if the end of the guide panel is close to the inner side of the piston.

The fluid pipe may have a diameter increased toward the discharge hole along the length direction, and if the plurality of guide panels are close to the discharge hole, their length protruded toward the inner side of the piston may be reduced.

The fluid pipe may be extended from the other end of the piston to the one end of the piston.

The fluid entering through the suction pipe may be charged in the case, and the inlet hole of the muffler may be provided at an opposite end of the compression chamber and thus the fluid inside the case may enter the inlet hole by means of movement of the piston.

The muffler may have a plurality of buffering spaces between the inlet hole and the fluid pipe, and the plurality of buffering spaces may be aligned along the length direction of the piston, and the fluid entering through the inlet hole may be provided to the fluid pipe by passing through the plurality of buffering spaces in due order.

The suction pipe, the inlet hole and the fluid pipe may be arranged on a straight line along the length direction of the piston.

The plurality of buffering spaces may mutually be partitioned by partitions, and the fluid may be transferred to the buffering spaces through a communication hole formed in each partition.

The embodiments of the present disclosure may effectively attenuate vibration and noise that may occur in the process of compressing a fluid.

Also, the embodiments of the present disclosure may effectively control a target frequency of vibration and noise to be attenuated by controlling a noise transfer path.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION

The detailed description of the preferred embodiments of the present disclosure is given with reference to the accompanying drawings to enable those skilled in the art to realize and implement the present disclosure.

The present disclosure may, however, be embodied in many different forms and should not be construed as being limited to the embodiments set forth herein. For definite description of the present disclosure, portions of drawings having no relation with the description will be omitted, and the same or like reference numbers will be used throughout the drawings to refer to the same or like parts.

In the present disclosure, repeated description for the same elements will be omitted.

The expression that an element is "connected" or "coupled" to another element should be understood that the element may directly be connected or coupled to another element, a third element may be interposed between the corresponding elements, or the corresponding elements may be connected or coupled to each other through a third element. On the other hand, the expression that an element is "directly connected" or "directly coupled" to another element" means that no third element exists therebetween.

The terms used in this specification are intended to describe the embodiments of the present disclosure, and should not be restrictive.

Also, it is to be understood that the singular expression used in this specification includes the plural expression unless defined differently on the context.

In this specification, it is to be understood that the terms such as "include" and "has" are intended to designate that features, numbers, steps, operations, elements, parts, or their combination, which are disclosed in the specification, exist, and are intended not to previously exclude the presence or optional possibility of one or more other features, numbers, steps, operations, elements, parts, or their combinations.

Also, in this specification, the terms such as "and/or" include a combination of a plurality of items which are disclosed or any one of the plurality of items. In this specification, "A or B" may include "A", "B" or "both of A and B".

Figure 1:
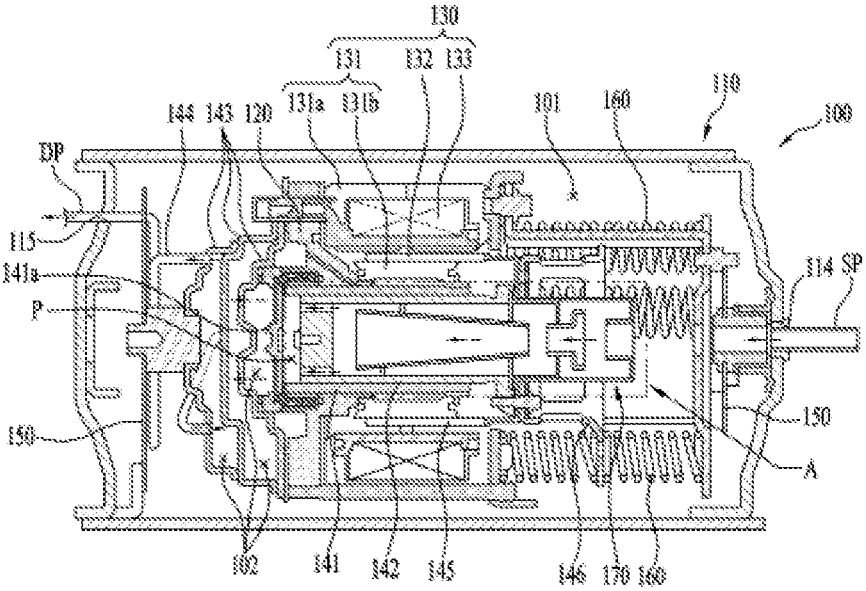
FIG. 1 is a view illustrating the inside of a compressor according to one embodiment of the present disclosure.
Figure 2:
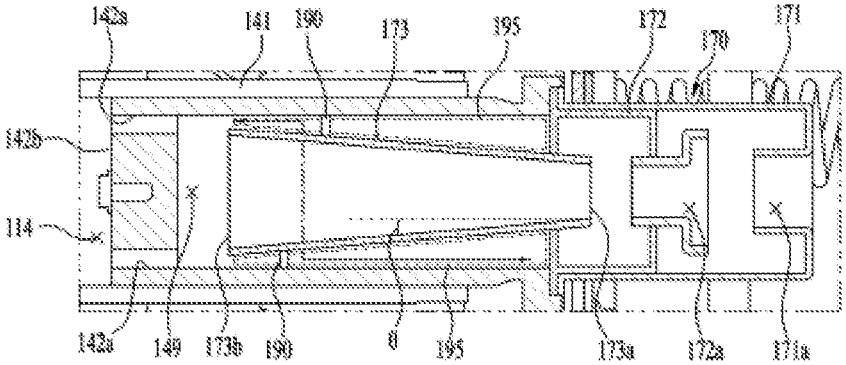
FIG. 2 is an enlarged view illustrating an area A of FIG. 1.

FIG. 1 is a longitudinal sectional view illustrating a compressor 100 according to one embodiment of the present disclosure, and FIG. 2 is an enlarged view illustrating an area A of FIG. 1.

The compressor 100 according to one embodiment of the present disclosure, as shown in FIGS. 1 and 2, includes a case 110 having a suction pipe SP to which a fluid is sucked, a cylinder 141 arranged inside the case 110, a piston 142 moving inside the cylinder 141, provided with a compression chamber P formed between one end and the cylinder 141, a fluid space 149 in which a fluid stays, and a fluid hole 142*a* formed at the one end, providing the fluid of the fluid space 149 to the compression chamber P, and a muffler 170 provided at the other end of the piston 142, discharging the fluid entering there from the outside of the piston through an inlet hole 171*a*, to the fluid space 149 through a discharge hole 173*b*.

The muffler 170 includes a fluid pipe 173 extended from the inside of the fluid space 149 in a length direction of the piston 142, having an end, at which the discharge hole 173*b* is arranged, and provided with a resonant space 195 formed between an outer circumferential surface and an inner circumferential surface of the piston 142, and a guide panel 190 protruded from the outer circumferential surface of the fluid pipe 173 to the inner circumferential surface of the piston 142 and extended along an outer circumferential direction of the fluid pipe 173.

The guide panel 190 is provided in a plural number and therefore arranged to be spaced apart from another guide panel in the resonant space 195 along the length direction of the fluid pipe 173. The guide panel 190 is partially opened along the outer circumferential direction of the fluid pipe 173 to form an open area 191. The open area 191 is formed in any one guide panel 190 based on the length direction of the fluid pipe 173 and covered by its adjacent guide panel 190.

As shown in FIG. 1, the case 110 may be provided with a sealed space therein. The sealed space may correspond to a suction space 101 filled with a fluid sucked for compression.

In the present disclosure, the fluid may be gas and liquid. For example, the fluid may be a refrigerant for temperature control in a refrigerator or an air conditioner.

The case 110 includes a suction pipe SP through which the fluid moves, and may be provided with a suction hole 114 penetrated by the suction pipe SP and connected with the suction pipe SP. Also, the case 110 may be provided with a discharge outlet 115 for discharging the fluid from a discharge space 102, which will be described later, to the outside, wherein the outside of the discharge outlet 115 may be connected with a discharge pipe DP.

The case 110 may be provided with a driving unit 130 and a compression unit 140 therein, and may also be provided with a frame 120 for supporting the driving unit 130 and the compression unit 140. The frame 120 may be connected to the other end of a support spring 150 arranged such that its one end is fixed to the case 110. As shown in FIG. 1, the support spring 150 may be made of a plate spring or a coil spring.

Although FIG. 1 shows that the frame 120, the driving unit 130 and the compression unit are provided as separate elements, the present disclosure is not limited thereto. The frame 120 may be provided in a single body with the driving unit 130, or may be provided in a single body with the compression unit.

The driving unit 130 may serve to generate a reciprocating movement of the compressor 100 according to one embodiment of the present disclosure. That is, the driving unit 130 may transfer a power for a reciprocating movement of the piston 142 to the piston 142.

The driving unit 130 may be provided in various types. For example, the driving unit 130 may include a crank shaft or a cam shaft to allow the piston 142 to perform linear movement, or may be provided in a solenoid type to use an electromagnetic force.

However, for convenience of description, one embodiment of the present disclosure will be described based on a linear compressor in which the driving unit 130 includes a stator 131 and a mover 132 as shown in FIG. 1.

Referring to FIG. 1, in one embodiment of the present disclosure, the driving unit 130 may include a stator 131 and a mover 132. The stator 131 may be coupled with the frame 120. The stator 131 may include an outer stator 131*a* arranged to surround the compression unit 140, and an inner stator 131*b* spaced apart from the inner side of the outer stator 131*a* to surround the compression unit 140.

The mover 132 may be arranged between the outer stator 131*a* and the inner stator 131*b*. A winding coil 133 may be provided in the outer stator 131*a*, and the mover 132 may include a permanent magnet.

If a current is applied to the driving unit 130, an electromagnetic field, that is, flux may be formed in the stator 131 by the winding coil 133. A moving force may occur in the mover 132 by means of mutual action between a flux formed by an applied current and a flux formed by a permanent magnet.

The compression unit 140 may suck, compress and discharge the fluid in the suction space 101. The compression unit 140 may be arranged at the center of the case 110 inside the inner stator 131*b*, and may include a cylinder 141 and a piston 142.

The cylinder 141 may be arranged inside the case 110, and may be supported by the frame 120. A compression chamber P may be formed inside the cylinder 141, and the cylinder 141 may be provided in a cylindrical shape having an opened side.

A discharge valve 141*a* and a discharge cover 143 may be provided at the other side of the cylinder 141. The discharge space 102 may be formed between the discharge valve 141*a* and the discharge cover 143.

The fluid compressed in the compression chamber P of the cylinder 141 may enter the discharge space 102 and then may be transferred to the outside of the case 110.

In one embodiment of the present disclosure, a plurality of discharge covers 143, which are overlapped with one another, may form a plurality of discharge spaces 102. A discharge tube 144 extended to communicate the discharge outlet 115 with the discharge space 102 may be provided in the case 110.

The piston 142 may be inserted into the cylinder 141 through the opened side of the cylinder 141, and the compression chamber P may be sealed by the piston 142. The piston 142 may be connected with the aforementioned mover 132.

Therefore, if a flux is formed in the stator 131, the piston 142 may move together with the mover 132. That is, the piston 142 may reciprocate together with the mover 132 of the driving unit 130. Since the inner stator 131*b* and the cylinder 141 may be arranged between the mover 132 and the piston 142, the mover 132 and the piston 142 may be coupled with each other by a separate connection member 145 formed to bypass the cylinder 141 and the inner stator 131*b*.

However, the present disclosure is not limited to the above example of the connection member 145. The connection member 145 may be provided in a single body with the piston 142, and the connection member 145 and the mover 132 may be formed in a single body.

The compression chamber P may be arranged between one end of the piston 142 inserted into the cylinder 141 and the cylinder 141. The piston 142 is provided with the fluid hole 142*a* formed to pass through one end for sealing the compression chamber P.

In this embodiment, the piston 142 is provided with a fluid space 149 therein. The fluid of the suction space 101 of the case 110 enters the fluid space 149 of the piston 142, and the fluid of the fluid space 149 may sucked into the compression chamber P between the piston 142 and the cylinder 141 by passing through the fluid hole 142*a*.

Also, a valve member 142*b* for opening or closing the fluid hole 142*a* may be provided at a section of one end of the piston 142. The valve member 142*b* may be provided in various types, and may be operated by elastic deformation as described later. That is, the valve member 142*b* may be elastically deformed to open the fluid hole 142*a* by a pressure of the fluid flowing to the compression chamber P by passing through the fluid hole 142*a*.

The compressor 100 according to one embodiment of the present disclosure may further include a resonant spring 160. The resonant spring 160 may assist compression of the fluid by amplifying vibration implemented by a reciprocating movement of the mover 132 and the piston 142.

For example, a support member 146 may be coupled to the connection member 145 for connecting the mover 132 with the piston 142, whereby the support member 146 and the connection member 145 may reciprocate in a single body. One end of the resonant spring 160 may be connected to the support member 146, and the other end of the resonant spring 160 may be connected to be fixed to the stator 131 and the stator cover.

When the piston 142 is vibrated with respect to the cylinder 141, the resonant spring 160 may be vibrated with a preset spring constant to implement resonance of the compression unit 140.

The operation of the compressor 100 according to one embodiment of the present disclosure will be described with reference to FIG. 1.

First of all, if a current is applied to the driving unit 130, the flux may be formed in the stator 131. The mover 132 provided with a permanent magnet may linearly reciprocate by means of an electromagnetic force generated by the flux formed in the stator 131.

When the mover 132 reciprocates, the piston 142 connected to the mover 132 may reciprocate. The piston 142, which linearly moves, that is, reciprocates inside the cylinder 141, repeats a movement for increasing and reducing a volume of the compression chamber P.

When the piston 142 moves while increasing the volume of the compression chamber P, a pressure inside the compression chamber P is reduced. As a result, the valve member 142*b* provided in the piston 142 is opened, and the fluid staying in the suction space 101 may be sucked into the compression chamber P.

That is, if the pressure of the fluid space 149 reaches a reference pressure or more higher than the pressure of the compression chamber P due to the reduced pressure of the compression chamber P, the valve member 142*b* may be elastically deformed by the above pressure difference to open the fluid hole 142*a*.

Such suction stroke is performed until the piston 142 is arranged at the bottom dead center (BDC) after the volume of the compression chamber P is increased to a maximum range. The piston 142 reaching the bottom dead center (BDC) performs a compression stroke while reducing the volume of the compression chamber P. The compression stroke is performed while the piston 142 is moving to the top dead center (TDC) for reducing the volume of the compression chamber P to reach a minimum value.

When the compression stroke is performed, the pressure inside the compression chamber P may be increased to compress the sucked fluid. If the pressure of the compression chamber P reaches a preset pressure, the discharge valve 141*a* provided in the cylinder 141 is opened to discharge the fluid to the discharge space 102.

As the suction and compression strokes of the piston 142 are repeated, the fluid of the suction space 101 is sucked to the compression chamber P through the fluid space 149 of the piston 142 and then compressed. A fluid flow for discharging the fluid to the outside of the compressor 100 through the discharge space 102, the discharge tube 144 and the discharge outlet 115 may be formed.

In the reciprocating movement of the piston 142, the resonant spring 160 may be compressed and elongated in accordance with the number of vibrations of the piston 142 to generate resonance, and the compressor may be operated efficiently in comparison with electric energy which is used.

Meanwhile, the compressor 100 according to one embodiment of the present disclosure may be an oil-less type in which oil is not used separately for lubrication and cooling between a fixed body that includes the cylinder 141 and the stator 131, and a vibration body that includes the mover 132 and the piston 142.

The oil-less type linear compressor 100 may be provided with a gas bearing for lubrication and cooling of a friction surface between the cylinder 141 and the piston 142. That is, the fluid from the discharge space 102 may partially be supplied to the outer circumferential surface of the piston 142 by a bearing path 121 formed in the frame 120, whereby a gas bearing film may be formed.

Meanwhile, the compression unit 140 according to one embodiment of the present disclosure may further include a muffler 170 provided in the piston 142. The muffler 170 coupled to the piston 142 is shown in FIGS. 1 and 2.

The muffler 170 may transfer the fluid from the suction space 101 to the fluid space 149 of the piston 142, and may attenuate vibration or noise that may occur during the operation of the compressor 100.

The muffler 170 may include a fluid pipe 173 and a guide panel 190. Meanwhile, as described later, the muffler 170 may further include an outer body portion 171 and an inner body portion 172. One end of the piston 142 may be provided with a fluid hole 142*a* to face the compression chamber P, and the other end of the piston 142 may be opened and the muffler 170 may be coupled to the opened other end.

The muffler 170 may further include a coupling unit 179 coupled to the other end of the piston 142, and the coupling unit 179 may be coupled to the piston 142 to seal the opened surface of the piston 142. The fluid pipe 173 may be arranged on one surface of the coupling unit 179, which is headed for the fluid space 149 of the piston 142, and the outer and inner body portions 171 and 172 may be arranged on the other surface opposite to the above one surface.

The fluid from the outside of the piston 142, that is, the suction space 101 may enter the muffler 170 through an inlet hole 171*a*. The fluid entering the muffler 170 moves to the fluid space 149 of the piston 142 through the discharge hole 173*b* of the muffler 170 by passing through the muffler 170.

In FIG. 2, the muffler 170 coupled to the opened other end of the piston 142 is shown, and a flow of the fluid transferred to the fluid space 149 of the piston 142 through the muffler 170 is marked with an arrow.

The fluid pipe 173 of the muffler 170 has a shape extended from the inside of the piston 142 along the length direction of the piston 142. In the present disclosure, it may be understood that the length direction of the piston 142, the length direction of the cylinder 141, the length direction of the fluid pipe 173, and a moving direction of the piston 142 are all the same as one another.

Referring to FIG. 2, the fluid pipe 173 may be extended from the coupling unit 179 coupled to the piston 142, and the discharge hole 173*b* of the muffler 170 is formed at the extended end. That is, the fluid passing through the muffler 170 is discharged to the fluid space 149 through the discharge hole 173*b* arranged at the end of the fluid pipe 173.

The inner circumferential surface of the fluid pipe 173 is spaced apart from the inner circumferential surface of the piston 142, whereby a resonant space 195 may be formed between the inner circumferential surface of the fluid pipe 173 and the inner circumferential surface of the piston 142. The resonant space 195 corresponding to some of the fluid space 149 is marked in FIG. 2.

The resonant space 195 may attenuate vibration or noise of the fluid space 149. In detail, the fluid in the fluid space 149 may move from the discharge hole 173*b* of the fluid pipe 173 toward the fluid hole 142*a* of the piston 142. This moving path may be a transfer path of noise and vibration.

In this case, the resonant space 195 which is a portion of the fluid space 149 and departs from the transfer path of noise and vibration may serve as a side branch resonator. For example, noise and vibration occurring in the fluid space 149 may be transferred to the resonant space 195 and then attenuated.

Meanwhile, the guide panel 190 of the muffler 170 in one embodiment of the present disclosure of FIG. 2 may be provided in a shape protruded from the outer circumferential surface of the fluid pipe 173. The end of the guide panel 190 protruded from the outer circumferential surface of the fluid pipe 173 may adjoin the inner circumferential surface of the piston 142.

Also, the guide panel 190 may be a ring shaped rim or may have a flange shape, and may be extended along the outer circumferential direction of the fluid pipe 173. For example, in one embodiment of the present disclosure, the guide panel 190 of C shape may be provided on the outer circumferential surface of the fluid pipe 173 of a circular section.

The guide panel 190 may have various materials. For example, the guide panel 190 may be provided to have the same material as that of the fluid pipe 173 and then molded in a single body with the fluid pipe 173. Alternatively, the guide panel 190 may be made of a separate material different from the fluid pipe 173 and coupled to the outer circumferential surface of the fluid pipe 173.

Meanwhile, the guide panel 190 is provided so as not to fully surround the outer circumferential surface of the fluid pipe 173. That is, the guide panel 190 is extended along the outer circumferential direction of the fluid pipe 173, and is partially opened to form the open area 191.

Figure 3:
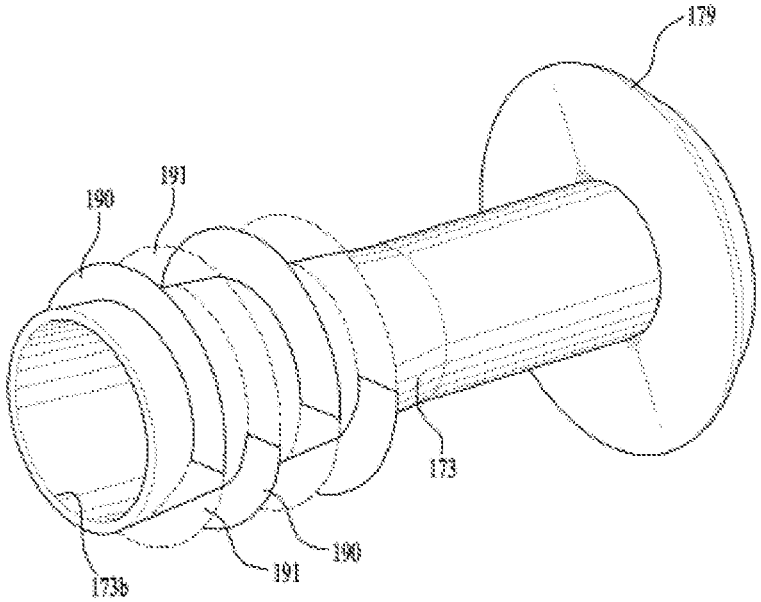
FIG. 3 is a view illustrating a fluid pipe of a muffler in a compressor according to one embodiment of the present disclosure.
Figure 4:
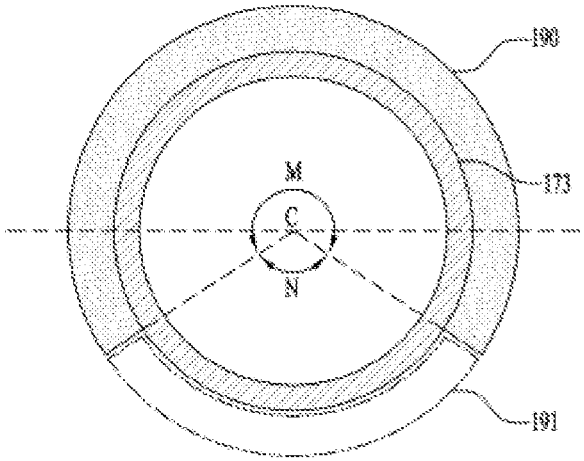
FIG. 4 is a view illustrating a guide panel and an open area of a fluid pipe in a compressor according to one embodiment of the present disclosure.

FIG. 3 shows that guide panel 190 having the open area 191 in accordance with one embodiment of the present disclosure, and FIG. 4 shows the guide panel 190 and the open area 191, which are viewed in the length direction of the fluid pipe 173.

In one embodiment of the present disclosure, the fluid space 149 is partitioned by the guide panel 190 at both sides of the guide panel 190. However, both sides of the fluid space 149 may be communicated with each other through the open area 191 of the corresponding guide panel 190.

Meanwhile, as shown in FIG. 3, the guide panel 190 may be provided in a plural number in one embodiment of the present disclosure. The plurality of guide panels 190 may be arranged to be spaced apart from one another along the length direction of the fluid pipe 173. Each of the plurality of guide panels 190 may be provided with the open area 191.

In one embodiment of the present disclosure, any one of the plurality of guide panels 190 is covered by another guide panel 190 adjacent to the open area 191. That is, when viewed from the length direction of the piston 142, an area where the plurality of open areas 191 are overlapped with one another does not exist.

In one embodiment of the present disclosure, a resonant frequency of the resonant space 195 between the fluid pipe 173 and the piston 142 may be reduced by the guide panel 190 and the open area 191. Deformation or impact of the valve member 142*b* and the other various types of noise and vibration transferred from the outside may exist in the fluid space 149 that includes the resonant space 195.

As described above, the resonant space 195 of the present disclosure may be a portion of the fluid space 149 and serve as a side branch resonator. In this case, the resonant frequency of the side branch resonator may be calculated as expressed by F=C/4L. That is, in one embodiment of the present disclosure, the resonant frequency of the resonant space 195 is inversely proportional to its length.

Meanwhile, in the resonant space, transfer of noise or vibration is performed through the open area 191 or an open section by bypassing the guide panel 190. In the present disclosure, the plurality of guide panels 190 are arranged in the resonant space 195 inside the piston 142 and the respective open areas 191 or the respective open sections of the plurality of guide panels 190 is arranged so as not to overlap each other in the length direction of the piston 142, whereby the transfer path of noise or vibration in the resonant space 195 may be increased. A noise transfer path of which length is increased by two guide panels 190 in accordance with one embodiment of the present disclosure is schematically shown in FIG. 2.

As the noise or vibration transfer path of the resonant space is increased, the resonant frequency of the resonant space 195 is lowered, whereby an attenuation effect of noise or vibration of a low frequency area in the piston 142 may be increased.

Moreover, in one embodiment of the present disclosure, the length of the noise transfer path may be adjusted in various ways depending on the number of the guide panels 190 or the position relation of the open areas 191. Therefore, the resonant frequency may properly be controlled and noise attenuation effect may be increased in a limited space inside the piston 142.

Figure 6:
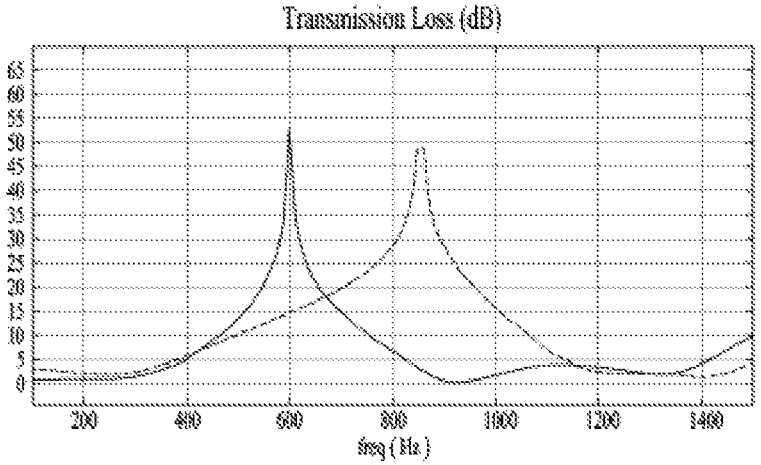
FIG. 6 is a view illustrating a change of a resonant frequency based on an open area formed in a compressor according to one embodiment of the present disclosure.

FIG. 6 is a graph illustrating a change of a resonant frequency based on the open area 191 of the guide panel 190 in one embodiment of the present disclosure. A result of noise attenuation before the open area 191 is formed is marked with a dotted line, and a result of noise attenuation when the open area 191 is formed is marked with a solid line. In FIG. 6, a horizontal axis denotes a frequency, and a vertical axis denotes the amount of noise attenuation.

In FIG. 6, the frequency having the highest amount of noise attenuation in the solid line and dotted line graphs may be understood as the resonant frequency. Referring to the change of the resonant frequency based on the presence of the open area 191, it is noted that the resonant frequency of the solid line graph where the open area 191 is formed is lower than the resonant frequency of the dotted line graph where the open area 191 is not formed.

That is, in one embodiment of the present disclosure, as the open area 191 is formed, the lower resonant frequency may be generated in the resonant space 195 of the same volume, and the resonant frequency may be controlled in various ways if necessary, whereby noise of the low frequency area may be attenuated even in the same volume.

Meanwhile, in the present disclosure, the guide panel 190 or the open area 191 may have various sectional shapes. FIGS. 3 and 4 show the guide panel 190 of an arc shape or C shape and the open area 191 constituting the other portion of the guide panel 190 in accordance with one embodiment of the present disclosure but are not limited thereto. For example, the guide panel 190 may be extended along the whole circumference of the fluid pipe 173, and a hole may be formed in a partial position of the guide panel 190, whereby the hole may constitute the open area 191.

One embodiment of the present disclosure may further include the valve member 142*b* as described above, and the valve member 142*b* may be arranged at the one end of the piston 142, and may open or close the fluid hole 142*a*.

If the valve member 142*b* is provided at one end of the piston 142, impact sound may be generated in accordance with the operation of the valve member 142*b*, wherein the impact sound may be transferred to the outside through the fluid space 149.

In one embodiment of the present disclosure, the noise transfer paths may effectively be increased using the plurality of guide panels 190 having the open area 191 in the resonant space 195 of the fluid space 149, whereby noise may effectively be reduced even in the case that the valve member 142*b* is provided in the piston 142, and the resonant frequency may be adjusted to a desired low frequency area.

Meanwhile, in one embodiment of the present disclosure, the valve member 142*b* may be elastically deformed to open the fluid hole 142*a* if the pressure of the fluid space 149 is higher than the pressure of the compression chamber P as much as a reference pressure or more.

As described above, in one embodiment of the present disclosure, the valve member 142*b* may be a valve panel arranged at one end of the piston 142, in which the fluid hole 142*a* is formed. The valve member 142*b* of a plate shape, which may be elastically deformed, may be deformed to be in surface contact with or to be spaced apart from one end of the piston 142 in accordance with the pressure change of the compression chamber P. An impact may occur between the valve member 142*b* and one end of the piston 142 depending on the deformed status of the valve member 142*b*, whereby noise may occur.

In the present disclosure, even though the mechanically simple and effective valve member 142*b* of a plate spring shape is used, noise on the fluid space 149 may effectively be attenuated by the resonant space 195 that has increased the transfer path.

Meanwhile, as described above, one embodiment of the present disclosure may further include the driving unit 130 arranged between the outer side of the cylinder 141 and the inner side of the case 110, having a winding coil 133 and linearly moving the piston 142 by means of an electromagnetic force of the winding coil 133.

The winding coil 133 may be wound in the stator 131, a flux may be formed if a power is provided to the stator 131, a moving force may be generated by mutual action between the flux of the stator 131 and the flux of the mover 132, and the piston 142 having a coupling relation through the mover 132 and the connection member 145 may move together with the mover 132.

In one embodiment of the present disclosure, the driving unit 130 includes a stator 131 including the winding coil 133 and a mover 132, whereby the linear compressor may be provided, which performs only linear movement without switching rotation movement to linear movement.

The linear compressor has less places, in which impact occurs, than the other compressors, and therefore may be effective for attenuation of noise.

Meanwhile, as shown in FIGS. 3 and 4, in one embodiment of the present disclosure, the guide panel 190 may be extended in an arc shape and surround some of the outer circumferential surface of the fluid pipe 173, and the other of the outer circumferential surface of the fluid pipe 173 may constitute the open area.

The guide panel 190 of an arc shape or C shape extended to partially surround the circumference of the fluid pipe 173 and the open area 191 having no guide panel 190 around the fluid pipe 173 are shown in FIG. 3. Also, FIG. 4 shows that the guide panel 190 and the open area 191 are viewed in the length direction of the fluid pipe 173.

Meanwhile, as shown in FIG. 3, in one embodiment of the present disclosure, the guide panel 190 may be extended in a self-arc shape when it is viewed in the length direction of the fluid pipe 173, and therefore may be provided to surround a half of the outer circumferential surface of the fluid pipe 173.

In one embodiment of the present disclosure, a plurality of open areas 191 provided with a plurality of guide panels 190 should not be overlapped with one another when viewed in the length direction of the fluid pipe 173. Referring to FIG. 4, an angle M between both ends of the guide panel 190, which face the open area 191 based on the center shaft C in the length direction of the fluid pipe 173 may be 180° or more.

Likewise, referring to FIG. 4, an angle N between both ends of the open area 191, which adjoin the guide panel 190, based on the center shaft C of the fluid pipe 173 may be less than 180°.

If the angle N formed by the open area 191 is too small, it may excessively restrict movement of the fluid in the linear reciprocating movement of the piston 142 and disturb the movement of the piston 142.

Therefore, in one embodiment of the present disclosure, on a section viewed in the length direction of the fluid pipe 173, the guide panel 190 may surround a half of the circumference of the fluid pipe 173, and the open area 191 may be formed in the other half of the circumference of the fluid pipe 173, whereby moving resistance of the fluid may be minimized and noise may be prevented from being linearly transferred from the resonant space 195.

Meanwhile, in one embodiment of the present disclosure, when viewed in the length direction of the fluid pipe 173, the open area 191 of any one of the plurality of guide panels 190 and the open area 191 of another guide panel 190 adjacent thereto may be arranged to be opposite to each other based on the fluid pipe 173.

FIGS. 2 and 3 show that the open areas 191 of the guide panels 190 adjacent to each other are arranged to be opposite to each other based on the center shaft C in the length direction of the fluid pipe 173. The position of the open area 191 may mean the position for the outer circumferential direction of the fluid pipe 173.

Also, in definition of the position of the open area 191, the open area 191 may be defined at the center based on the outer circumferential direction of the fluid pipe 173. For example, FIG. 3 shows that the plurality of open areas 191 are alternately arranged in the direction of 0° and 180° based on the center shaft C of the fluid pipe 173 in accordance with one embodiment of the present disclosure.

In one embodiment of the present disclosure, an acoustic effective length of the resonant space 195 may be increased through the open area 191 in the resonant space 195 of the same volume, and the open areas 191 adjacent to each other may be arranged to be opposite to each other based on the center shaft C of the fluid pipe 173 to maximize the amount of the increased length.

Figure 5:
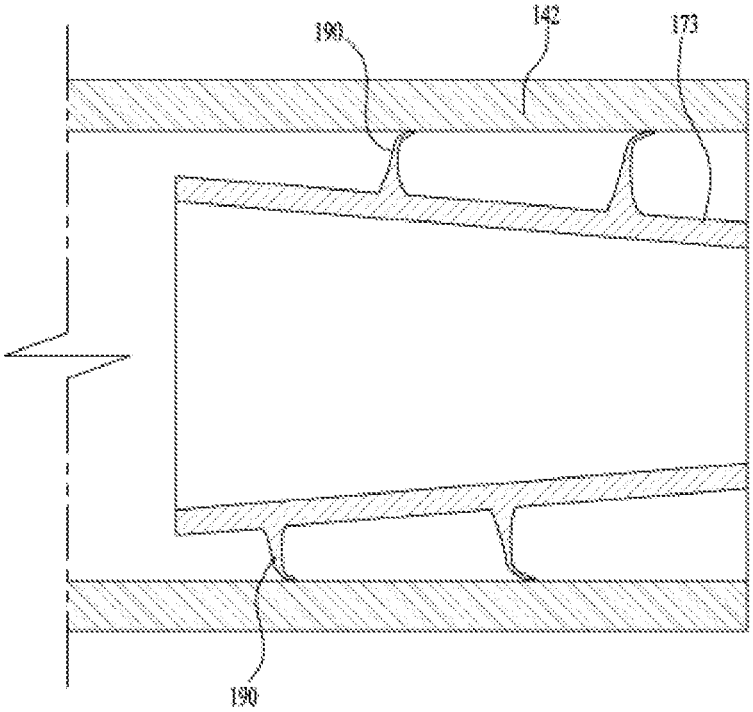
FIG. 5 is a view illustrating a curved end of a guide panel in a compressor according to one embodiment of the present disclosure.

Meanwhile, FIG. 5 shows that the end of the guide panel 190 is provided in a curved shape in one embodiment of the present disclosure. As shown in FIG. 5, in one embodiment of the present disclosure, the guide panel 190 may be provided with a curved end which is in contact with the inner side of the piston 142.

In the muffler 170, the fluid pipe 173 and the guide panel 190 are inserted into the fluid space 149 of the piston 142, and as described above, the end of the guide panel 190 is in contact with the inner circumferential surface of the piston 142 and partitions the resonant space 195 based on a radius direction of the fluid pipe 173 to effectively increase the acoustic effective length of the resonant space 195.

However, in manufacture of the guide panel 190 and coupling between the guide panel 190 and the piston 142, a tolerance may occur between the end of the guide panel 190 and the inner circumferential surface of the piston 142. In one embodiment of the present disclosure, the end of the guide panel 190 may be manufactured to be curved and inserted into the piston 142 to prevent such a tolerance from being generated.

The end of the guide panel 190 may have various shapes such as curvature or curved length, and the guide panel 190 may fully be provided in a curved shape. The curved end of the guide panel 190 may be inserted into the piston 142 and deformed by being pressurized by the inner circumferential surface of the piston 142, whereby the curved end of the guide panel 190 may be inserted and fixed into the piston 142.

In one embodiment of the present disclosure, the end of the guide panel 190 may be provided in a curved shape, whereby the tolerance between the guide panel 190 and the inner circumferential surface of the piston 142 may be prevented from occurring, and a contact area between the guide panel 190 and the piston 142 may be increased. Also, the guide panel 190 may be pressurized and deformed by the inner circumferential surface of the piston 142 to rigidly and stably partition the resonant space 195.

Meanwhile, the guide panel 190 may have the end curved in a direction away from the compression chamber P. The guide panel 190 may be inserted into an opposite end of the compression chamber P from the piston 142, and since the end of the guide panel 190 has a shape curved through the opposite side of the compression chamber P, a curved direction of the end may correspond to the inserted direction of the guide panel 190 during insertion of the guide panel 190, whereby structural stability may be obtained.

Meanwhile, in the compressor 100 according to one embodiment of the present disclosure, at least a portion of the fluid pipe 173 has a diameter increased toward the discharge hole 173*b* along the length direction, and the protruded length of the plurality of guide panels 190 may be reduced toward the discharge hole 173*b*.

In detail, as shown in FIGS. 1 and 2, the fluid pipe 173 provided in the muffler 170 of the present disclosure may include a pipe inlet 173*a* through which the fluid of the suction space 101 enters, wherein the pipe inlet 173*a* may be formed with an inner diameter smaller than that of the discharge hole 173*b* inserted into the piston 142 and headed for the compression chamber P.

In the section that the fluid passes through the fluid pipe 173, if the inner diameter of the discharge hole 173*b* is formed to be greater than that of the pipe inlet 173*a*, a fluid velocity in the discharge hole 173*b* may be slower than a fluid velocity in the pipe inlet 173*a*.

At this time, if Bernoulli equation is applied to a control volume set along a streamline from the pipe inlet 173*a* to the discharge hole 173*b*, it is noted that a fluid pressure in the discharge hole 173*b* is greater than that in the pipe inlet 173*a*.

The Bernoulli equation assumes an ideal status having no loss due to friction, but a design for increasing a pressure in the discharge hole 173*b* in accordance with a fluid velocity and a total length of the fluid pipe 173 may be devised even in the structure of the present disclosure.

Therefore, in the compressor 100 according to the present disclosure, as the fluid sucked into the compression chamber P passes through the muffler 170, noise may be attenuated and a relatively high pressure may be obtained at the discharge hole 173*b* of the muffler 170, through which the fluid is finally discharged.

The fluid having a high pressure may exactly open the valve member 142*b* that closes the fluid hole 142*a*. Particularly, even in that the piston 142 is vibrated at high speed, reliability of an operation for sucking the fluid may be ensured, and efficiency of the compressor 100 may be improved.

Meanwhile, in the muffler 170 of the present disclosure, in order that a path sectional area is ideally enlarged while the fluid is flowing from the pipe inlet 173*a* of the fluid pipe 173 to the discharge hole 173*b*, it is favorable that the path sectional area is gradually increased.

That is, the fluid pipe 173 according to one embodiment of the present disclosure may be provided such that a sectional area of at least a portion is gradually increased between the pipe inlet 173*a* and the discharge hole 173*b* like a diffuser.

FIGS. 1 and 2 show that the sectional area of the fluid pipe 173 is gradually increased with respect to a total length in accordance with one embodiment of the present disclosure. The fluid pipe 173 may form a truncated cone shaped space in accordance with a gradual increase of the sectional area.

Meanwhile, referring to FIG. 2, in one embodiment of the present disclosure, a diameter of the fluid pipe 173 may be increased to have a preset inclined angle θ. In order to obtain an effect of a pressure increase, the preset inclined angle θ may be designed to have a value of 1° or more.

Also, the diameter of the fluid pipe 173 may be increased to form a curved outer wall. That is, the diameter of the fluid pipe 173 may gradually be increased such that the inner circumferential surface is convex and the outer circumferential surface is concave.

Therefore, as the path sectional area is gradually enlarged, the pressure of the fluid flowing along the fluid pipe 173 may be increased. Therefore, a stall phenomenon, in which a flow of the fluid flowing to be close to the inner circumferential surface of the fluid pipe 183 is detached from the inner circumferential surface due to a rapid enlargement of the inner diameter, may be suppressed.

If the stall phenomenon occurs, the sectional area of the path is not enlarged, and it is difficult to obtain the effect of pressure increase. Therefore, as the diameter of the fluid pipe 173 is continuously increased, the effects of the present disclosure, in which the fluid flow is guided and the pressure is increased, may be achieved more stably.

Also, the fluid flowing in the fluid pipe 173 may form a flow close to a laminar flow. If the path is rapidly enlarged, the fluid flow is likely to form turbulence. If turbulence is formed, resistance of the fluid flow is increased, whereby loss of a flow energy may be caused.

That is, in one embodiment of the present disclosure, energy loss generated by the flow of the fluid sucked to the compression chamber P in the suction space 101 may be reduced.

Meanwhile, in one embodiment of the present disclosure, the fluid pipe 173 may be extended from the other end of the piston 142 toward the one end of the piston 142. Therefore, the resonant space 195 may have a side branch resonator type of which one side is closed by the coupling unit 179 of the muffler 170 and the other side is opened.

Meanwhile, the fluid entering through the suction pipe SP may be charged in the case 110, and the inlet hole 171*a* of the muffler 170 may be arranged at the opposite end of the compression chamber P such that the fluid in the case 110 may enter the inlet hole 171*a* in accordance with movement of the piston 142.

Referring to FIG. 1, the inlet hole 171*a* of the muffler 170 may be arranged at the opposite end of the compression chamber P based on the length direction of the piston 142, and may be provided toward the length direction of the piston 142.

Therefore, when the piston 142 moves to be away from the compression chamber P, the fluid charged in the suction space 101 of the case 110 may enter the inlet hole 171*a* of the muffler 170 due to the movement of the piston 142.

That is, in one embodiment of the present disclosure, even though a separate power for allowing the fluid to enter the inlet hole or moving the fluid is not consumed, the fluid may move into the muffler 170 and may be provided to the compression chamber P by only movement of the piston 142.

Meanwhile, in one embodiment of the present disclosure, the muffler 170 has a plurality of buffering spaces between the inlet hole 171*a* and the fluid pipe 173, wherein the plurality of buffering spaces may be aligned along the length direction of the piston 142 and the fluid entering through the inlet hole 171*a* may sequentially be transferred to the buffering spaces.

The muffler 170 provided with the plurality of buffering spaces are shown in FIGS. 1 and 2. In one embodiment of the present disclosure, the muffler 170 may have outer and inner body portions 171 and 172, and the inner body portion 172 may be coupled with the coupling unit 179 or may be formed in a single body with the coupling unit 179.

Also, the outer and inner body portions 171 and 172, as shown in FIGS. 1 and 2, may be manufactured separately and then coupled with each other. In this case, the outer and inner body portions 171 and 172 may have their respective buffering spaces.

Meanwhile, the outer and inner body portions 171 and 172 may be manufactured in a single body. In this case, the plurality of buffering spaces may mutually be partitioned by partitions existing inside the body portions.

Referring to FIGS. 1 and 2, in one embodiment of the present disclosure, the outer and inner body portions 171 and 172 may form a path through which the fluid enters and flows, and may be formed to restrict movement of the fluid in accordance with their inner structures.

In one embodiment of the present disclosure, the coupling unit 179 may be coupled to the open surface of the piston 142, the fluid pipe 173 may be extended from the coupling unit 179 toward the compression chamber P, and the inner body portion 172 may be formed in a single body with the coupling unit 179.

That is, a surface of the inner body portion 172, which is headed for the piston 142, may correspond to the coupling unit 179, and may be provided with a buffering space therein, and another surface of the inner body portion 172, which is opposite to the piston 142, may correspond to a partition for partitioning the buffering space, and the partition may be provided with a communication hole 172*a*.

The output body portion 171 is opened toward the inner body portion 172, and the inner body portion 172 may be coupled to the opened surface of the outer body portion 171. In detail, the inner body portion 172 may be inserted into the outer body portion 171, and the partition of the inner body portion 172 may seal the buffering space formed in the outer body portion 171.

Various shapes and coupling structures of the outer and inner body portions 171 and 172 may be provided. For example, a sectional shape of each of the outer and inner body portions 171 and 172 may be provided to correspond to the sectional shape of the piston 142.

As shown in FIG. 2, the outer body portion 171 may be provided with the inlet hole 171*a* of the muffler 170, and one surface of the inner body portion 172 may correspond to the partition for partitioning the buffering space and may be provided with a communication hole 172*a* on the partition.

When the fluid moves from the inlet hole 171*a* of the outer body portion 171 to the communication hole 172*a* formed on the partition of the inner body portion 172, one end or front end of the communication hole 172*a* close to the inlet hole 171*a* is provided with a great diameter, whereby the flow velocity may be reduced.

Also, impact caused by a change of the fluid flow may be buffered by the buffering space formed at the outer circumference of the communication hole 172*a* and the inlet hole 171*a*. Therefore, when the fluid passes through the outer and inner body portions 171 and 172, noise caused by periodic change of the fluid flow may be reduced.

The fluid pipe 173 provides a path through which the fluid that has passed through the outer and inner body portions 171 and 172 at one end of the piston 142 may move to one end of the piston 142 where the compression chamber P is formed. That is, the fluid that has passed through the inside of each of the inlet hole 171*a* and the communication hole 172*a* and a noise space surrounding the inlet hole 171*a* and the communication hole 172*a* may enter the pipe inlet 173*a* of the fluid pipe 173, flow to the discharge hole 173*b* and enter the fluid space 149 and the compression chamber P.

Meanwhile, referring to FIG. 1, in one embodiment of the present disclosure, the suction pipe SP, the inlet hole 171*a*, the communication hole 172*a* and the fluid pipe 173 may be arranged on a straight line along the length direction of the piston 142.

The piston 142 may linearly reciprocate along the length direction, and as described above, in accordance with the movement of the piston 142, the fluid may enter the muffler 170 and the fluid space 149 of the piston 142. The suction pipe SP of the case 110, the inlet hole 171*a* of the muffler 170, the communication hole 172*a* of the partition for partitioning the buffering space, and the pipe inlet 173*a* and the discharge hole 173*b* of the fluid pipe 173 may be arranged on a straight line to allow the fluid to easily enter there.

Meanwhile, referring to FIG. 2, in one embodiment of the present disclosure, the fluid may be transferred to the plurality of buffering spaces through the communication hole 172*a* formed on the partition for partitioning the buffering spaces, and the buffering space may have a sectional area greater than the inlet hole 171*a* and the communication hole 172*a* based on the length direction of the fluid pipe 173.

The partition may be formed on one surface of the inner body portion 172, and each of the buffering spaces formed in the outer and inner body portions 171 and 172 may have a sectional area greater than the inlet hole 171*a* and the communication hole 172*a* and attenuate noise.

It will be apparent to those skilled in the art that the present disclosure may be embodied in other specific forms without departing from the spirit and essential characteristics of the present disclosure. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A compressor comprising:

a case that includes a suction pipe configured to suction a fluid;

a cylinder that is disposed inside the case;

a piston that is configured to reciprocate in the cylinder and that defines a compression chamber between the cylinder and a first piston end of the piston, wherein the piston defines a fluid space that is configured to receive the fluid from the case, and wherein the first piston end defines a fluid hole that is configured to transfer the fluid from the fluid space to the compression chamber; and a muffler that is disposed at a second piston end of the piston that is opposite to the first piston end, wherein the muffler includes an inlet hole configured to receive the fluid from the case and a discharge hole configured to discharge the fluid to the fluid space of the piston, a fluid pipe that is at least partially disposed in the fluid space and that has an end that defines the discharge hole, wherein the fluid pipe defines a resonant space between an outer circumferential surface of the fluid pipe and an inner circumferential surface of the piston, and a plurality of guide panels that protrude from the outer circumferential surface of the fluid pipe toward the inner circumferential surface of the piston and that extend along an outer circumferential direction of the fluid pipe, wherein the plurality of guide panels are spaced apart from each other along a longitudinal direction of the fluid pipe, wherein each of the plurality of guide panels defines an open area around the outer circumferential surface of the fluid pipe in the resonant space, wherein each open area overlaps with an adjacent guide panel of the plurality of guide panels along the longitudinal direction of the fluid pipe, and wherein each open area is disposed to be opposite to the open area of the adjacent guide panel of the plurality of the guide panels.

2. The compressor of claim 1, further comprising a valve member that is disposed at the first piston end and configured to open or close the fluid hole of the piston.

3. The compressor of claim 2, wherein the valve member is configured to elastically deform to open the fluid hole based on a pressure within the fluid space being higher than a pressure of the compression chamber.

4. The compressor of claim 1, further comprising a piston driver that is disposed between the cylinder and the case and that includes a winding coil configured to generate an electromagnetic force to linearly move the piston.

5. The compressor of claim 1, wherein each of the plurality of guide panels extends along the outer circumferential direction of the fluid pipe in an arc shape and surrounds a first circumferential part of the outer circumferential surface of the fluid pipe along the outer circumferential direction of the fluid pipe, and wherein the open area of each of the plurality of guide panels is disposed at a second circumferential part of the outer circumferential surface of the fluid pipe along the outer circumferential direction of the fluid pipe.

6. The compressor of claim 5, wherein each of the plurality of guide panels includes a half-arc shape that surrounds a half of the outer circumferential surface of the fluid pipe along the outer circumferential direction of the fluid pipe.

7. A compressor comprising:

a case that includes a suction pipe configured to suction a fluid;

a cylinder that is disposed inside the case;

a piston that is configured to reciprocate in the cylinder and that defines a compression chamber between the cylinder and a first piston end of the piston, wherein the piston defines a fluid space that is configured to receive the fluid from the case, and wherein the first piston end defines a fluid hole that is configured to transfer the fluid from the fluid space to the compression chamber; and a muffler that is disposed at a second piston end of the piston that is opposite to the first piston end, wherein the muffler includes an inlet hole configured to receive the fluid from the case and a discharge hole configured to discharge the fluid to the fluid space of the piston, a fluid pipe that is at least partially disposed in the fluid space and that has an end that defines the discharge hole, wherein the fluid pipe defines a resonant space between an outer circumferential surface of the fluid pipe and an inner circumferential surface of the piston, and a plurality of guide panels that protrude from the outer circumferential surface of the fluid pipe toward the inner circumferential surface of the piston and that extend along an outer circumferential direction of the fluid pipe, wherein the plurality of guide panels are spaced apart from each other along a longitudinal direction of the fluid pipe, wherein each of the plurality of guide panels defines an open area around the outer circumferential surface of the fluid pipe in the resonant space, wherein each open area overlaps with an adjacent guide panel of the plurality of guide panels along the longitudinal direction of the fluid pipe, and wherein each of the plurality of guide panels has a curved end that contacts an inner side of the piston.

8. The compressor of claim 7, wherein the curved end is curved in a direction away from the compression chamber.

9. A compressor comprising: a case that includes a suction pipe configured to suction a fluid; a cylinder that is disposed inside the case, a piston that is configured to reciprocate in the cylinder and that defines a compression chamber between the cylinder and a first piston end of the piston, wherein the piston defines a fluid space that is configured to receive the fluid from the case, and wherein the first piston end defines a fluid hole that is configured to transfer the fluid from the fluid space to the compression chamber; and a muffler that is disposed at a second piston end of the piston that is opposite to the first piston end, wherein the muffler includes an inlet hole configured to receive the fluid from the case and a discharge hole configured to discharge the fluid to the fluid space of the piston, a fluid pipe that is at least partially disposed in the fluid space and that has an end that defines the discharge hole, wherein the fluid pipe defines a resonant space between an outer circumferential surface of the fluid pipe and an inner circumferential surface of the piston, and a plurality of guide panels that protrude from the outer circumferential surface of the fluid pipe toward the inner circumferential surface of the piston and that extend along an outer circumferential direction of the fluid pipe, wherein the plurality of guide panels are spaced apart from each other along a longitudinal direction of the fluid pipe, wherein each of the plurality of guide panels defines an open area around the outer circumferential surface of the fluid pipe in the resonant space, wherein each open area overlaps with an adjacent guide panel of the plurality of guide panels along the longitudinal direction of the fluid pipe, wherein the fluid pipe has a diameter that increases toward the discharge hole along the longitudinal direction, and wherein a first guide panel of the plurality of guide panels has a radial height that is greater than a radial height of a second guide panel of the plurality of guide panels, the second guide panel being positioned closer to the discharge hole than the first guide panel, and wherein each of the guide panels contacts the inner circumferential surface of the piston.

10. The compressor of claim 9, wherein the fluid pipe extends between the first piston end and the second piston end.

11. The compressor of claim 1, wherein the fluid that enters through the suction pipe is received in the case, and wherein the inlet hole of the muffler is disposed at an opposite side of the muffler from the compression chamber such that the fluid that is received in the case enters the inlet hole based on movement of the piston.

12. The compressor of claim 1, wherein the muffler defines a plurality of buffering spaces between the inlet hole and the fluid pipe, wherein the plurality of buffering spaces are aligned along a longitudinal direction of the piston, and wherein the fluid that enters through the inlet hole passes through the plurality of buffering spaces.

13. The compressor of claim 12, wherein the suction pipe, the inlet hole and the fluid pipe are arranged on a straight line along the longitudinal direction of the piston.

14. The compressor of claim 12, wherein the plurality of buffering spaces are divided by partitions, and wherein the fluid is transferred to the plurality of buffering spaces through communication holes that are defined in the partitions respectively.

15. The compressor of claim 5, wherein the first circumferential part and the second circumferential part of the outer circumferential surface of the fluid pipe define a full circumference of the outer circumferential surface of the fluid pipe along the outer circumferential direction of the fluid pipe.

16. The compressor of claim 1, wherein the muffler includes a coupler that connects the muffler to the piston.

17. The compressor of claim 16, wherein the muffler includes outer and inner body portions.

18. The compressor of claim 17, wherein the coupler is coupled to the inner body portion of the muffler.

* * * * *